US006250227B1

(12) United States Patent
Salort

(10) Patent No.: US 6,250,227 B1
(45) Date of Patent: Jun. 26, 2001

(54) PROVISIONAL LINKING AND PYROTECHNIC SEPARATION DEVICE FOR TWO NONMETALLIC ASSEMBLIES

(75) Inventor: Cédric Salort, Ville d'Avray (FR)

(73) Assignee: Aerospatiale Societe Nationale Industrielle, Paris (FR)

( * ) Notice: Subject to any disclaimer, the term of this patent is extended or adjusted under 35 U.S.C. 154(b) by 0 days.

(21) Appl. No.: 09/323,826

(22) Filed: Jun. 2, 1999

(30) Foreign Application Priority Data

Jun. 2, 1998 (FR) ..... 98 06897

(51) Int. Cl.[7] ..... F42B 15/10; F42B 3/00

(52) U.S. Cl. ..... 102/378; 102/378; 102/312; 102/313; 89/1.15; 89/1.14

(58) Field of Search ..... 102/378, 312, 102/313, 333; 89/1.14, 1.15

(56) References Cited

U.S. PATENT DOCUMENTS

| | | | | |
|---|---|---|---|---|
| 3,362,290 | * | 1/1968 | Carr et al. | 102/378 |
| 3,453,960 | | 7/1969 | Qualls . | |
| 3,486,410 | | 12/1969 | Drexelius et al. . | |
| 3,646,887 | | 3/1972 | Stine . | |
| 3,698,281 | | 10/1972 | Brandt et al. | 89/1 |
| 4,137,848 | * | 2/1979 | Cunha | 102/49.5 |
| 4,314,500 | | 2/1982 | Hoppe . | |
| 4,685,376 | * | 8/1987 | Noel et al. | 89/1.14 |
| 5,109,749 | * | 5/1992 | Olcer | 89/1.14 |
| 5,129,306 | * | 7/1992 | Fauvel | 89/1.14 |
| 5,372,071 | * | 12/1994 | Richards et al. | 102/378 |
| 5,969,287 | * | 10/1999 | Blain et al. | 102/378 |
| 5,983,802 | * | 11/1999 | Blain et al. | 102/378 |
| 5,992,328 | * | 11/1999 | Blain et al. | 102/378 |

FOREIGN PATENT DOCUMENTS

| | | |
|---|---|---|
| 0 273 061 | 7/1988 | (EP) . |
| 2 598 796 | 5/1986 | (FR) . |
| WO 87/07006 | 11/1987 | (WO) . |

* cited by examiner

*Primary Examiner*—Michael J. Carone
*Assistant Examiner*—Lulit Semunegus
(74) *Attorney, Agent, or Firm*—Oblon, Spivak, McClelland, Maier & Neustadt, P.C.

(57) ABSTRACT

A provisional linking and pyrotechnic separation device is placed between two assemblies made from nonmetallic materials such as composite materials. Prior to separation, parts belonging to each of the two assemblies are fixed to one another, either by direct bonding of the parts to one another, or by bonding a linking part to the parts. The device includes a pyrotechnic expansion tube acting directly on one of the parts to be separated. A precise, clean and well localized separation of the assemblies consequently takes place during the use or operation of the pyrotechnic expansion tube.

19 Claims, 2 Drawing Sheets

PROVISIONAL LINKING AND PYROTECHNIC SEPARATION DEVICE FOR TWO NONMETALLIC ASSEMBLIES

TECHNICAL FIELD

The invention relates to a device using a pyrotechnic expansion tube for separating two initially interconnected assemblies.

Such a device can in particular be used in the aeronautical and space industries for provisionally linking two structural assemblies and for controlling their separation in a very short time.

PRIOR ART

When two initially interconnected metallic assemblies have to be irreversibly separated in a short time and by remote control, use is currently made of pyrotechnic cutting devices integrated into the junction zone between the two assemblies.

When it is wished to carry out a clean cutting, i.e. with a minimum amount of dust being released, use is generally made of a cutting device including a pyrotechnic expansion tube.

The express "pyrotechnic expansion tube" designates a tight, deformable, metal tube, in which runs a detonating cord or fuse. A flexible material, such as silicone rubber, is interposed between the detonating fuse and the envelope. Prior to firing, the envelope has an oblong cross-section, e.g. in the form of an ellipse or a flattened circle.

When the detonating fuse is fired, the shock wave which propagates at a very high velocity along the tube deforms the envelope and tends to give it a substantially circular cross-section.

Conventionally a pyrotechnic cutting device including a pyrotechnic expansion tube is used for cutting metal parts. To this end it is installed in a space formed between two metal parts or between two portions of the same metal part. The part or parts to be cut are previously machined, so as to have a reduced thickness zone along each desired cutting line. The expansion of the envelope caused by the firing of the detonating fuse leads to the cutting of the part or parts along the cutting line corresponding to the machined zone.

Devices for cutting one or two metal parts by means of a pyrotechnic expansion tube are more particularly described in the documents U.S. Pat. Nos. 3,486,410, 3,453,960, 3,698,281, FR-A-2 598 796 and EP-A-0 273 061.

The structural elements used in the aeronautical and space industries are increasingly frequently made from nonmetallic materials. In particular, the materials used are often composite materials, i.e. materials formed from long fibres arranged in the form of superimposed sheets in preferred directions and embedded in a resin matrix.

When such nonmetallic materials are used, it is not possible at present to directly cut them by means of a pyrotechnic expansion tube, as is normally the case with metallic structures.

Thus, the direct cutting of a nonmetallic material, particularly of the composite type, by means of a cutting device incorporating a pyrotechnic expansion tube might give rise to significant pollution of the environment, as well as to a significant reduction in the mechanical characteristics of the adjoining structures. This reduction would lead to so-called delamination phenomena, i.e. a detachment or separation of the fibre sheets in the vicinity of the cutting line.

Thus, when a pyrotechnic cutting device has to be used at present in a nonmetallic structure, interposing takes place between the two structural assemblies to be separated of a metallic structure, whereof the cutting with the aid of a pyrotechnic expansion tube is controlled. In other words, the separation is ensured by cutting one or more joined metallic parts on the nonmetallic material structural assemblies which it is wished to separate. This conventional arrangement makes the structure more complicated and increases its costs.

It is also in opposition to one of the essential advantages resulting from nonmetallic materials, which is the weight gain. Thus, the addition of metallic parts in the junction or connection zone between the two structural assemblies to be separated leads to a non-negligible weight increase. This weight increase is particularly due to the metallic character of the added parts and the indispensable presence of fixing members ensuring the connection between the metallic parts and the nonmetallic parts. This is a particularly prejudicial disadvantage in certain applications, such as in the space industry.

The pyrotechnic cutting of metallic parts also makes it necessary to produce a relatively high shock. This shock is applied to the equipment and instruments, which are often of a very sensitive nature and located in the vicinity thereof.

SUMMARY OF THE INVENTION

The object of the invention is a provisional linking and pyrotechnic separation device making it possible to directly separate nonmetallic assemblies and in particular composite material assemblies by means of a pyrotechnic expansion tube, whilst maintaining the mechanical properties of these assemblies following their separation, whilst greatly limiting pollution and significantly reducing the shock produced during separation.

According to the invention, this result is obtained by means of a provisional linking and pyrotechnic separation device comprising a pyrotechnic expansion tube installed in a space provided in a linking zone between two assemblies to be separated, characterized in that the two assemblies are provisionally fixed to one another in the linking zone, by bonding nonmetallic material parts liable to be separated by the use of the pyrotechnic expansion tube.

The use of bonding for linking the two assemblies prior to their separation makes it possible to provisionally fix to one another nonmetallic parts and eliminates the need to cut the parts in order to separate them, in all cases where high forces or stresses must not initially be transmitted between the two assemblies.

Consequently, a clean and precise separation of the two assemblies is ensured, whilst producing a much weaker shock than during the cutting of metallic parts. The mechanical integrity of the two assemblies is consequently maintained after their separation, which also protects the embarked instruments and equipment.

Finally, a significant weight gain is obtained, due to the disappearance of metallic parts in the junction zone between the two assemblies.

In a first embodiment of the invention, the parts comprise at least one linking part bonded to adjacent portions of a first part and a second part arranged end to end and respectively belonging to each of said assemblies. The pyrotechnic expansion tube is then housed in a space formed opposite to the linking part and substantially facing said adjacent portion of the second part.

In a second embodiment of the invention, the parts comprise at least one first part and at least one second part respectively belonging to each of said assemblies. An end portion of the second part is then bonded to an end portion of the first part, beyond an adjacent portion of the second part defining said space.

Each of these two embodiments of the invention can apply to the case where a first of the assemblies to be separated comprises a single first part, a first spacer and a support part, the second assembly comprising a single second part. The space in which is received the pyrotechnic expansion tube is then defined between the support part, the first spacer and the adjacent portion of the second part.

Each of the two embodiments of the invention can also apply to the case where a first of the assemblies to be separated comprises two first parts and a second spacer linking said first parts, the second assembly comprising two second parts and a second spacer linking said second parts. The space in which is received the pyrotechnic expansion tube is then defined between said adjacent portions of the second parts and between the first and second spacers.

In the latter case, second fixing means link the second parts to the second spacer at a location remote from said space.

When each of the assemblies comprises two parts, the first assembly can also comprise a first core linking the two first parts outside the first spacer and the second assembly can comprise a second core linking the two second parts outside the second spacer and said space.

Preferably, one face of the first spacer turned towards said space is substantially aligned with an edge of each first part.

In addition, first fixing means advantageously connect each first part to the first spacer, in the vicinity of said space.

BRIEF DESCRIPTION OF THE DRAWINGS

The invention is described in greater detail hereinafter relative to non-limitative embodiments and with reference to the attached drawings, wherein show.

DETAILED DESCRIPTION OF SEVERAL PREFERRED EMBODIMENTS OF THE INVENTION

Figure 1A:
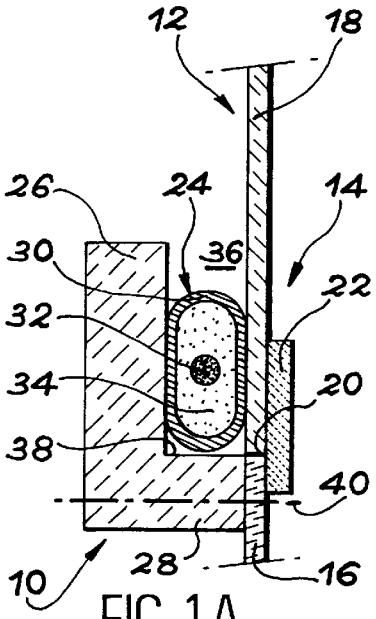
FIGS. 1A and 1B Sectional views diagrammatically representing a first embodiment of the device according to the invention, respectively before and after separation, in the case where only two nonmetallic parts have to be separated.

In FIG. 1A, reference numerals 10 and 12 designate two structural assemblies, which are initially fixed to one another and which it is wished to separate by using pyrotechnic separation means. The device according to the invention, which ensures both the provisional linking of assemblies 10 and 12 and their pyrotechnic separation is generally designated by reference numeral 14.

In this first embodiment, the first and second structural assemblies 10, 12 respectively comprise a first nonmetallic part 16 and a second nonmetallic part 18.

The nonmetallic material from which are formed the parts 16 and 18 can be of different types without passing beyond the scope of the invention. A preferred application relates to the case where said material is a composite material, formed from sheets of long fibres embedded in a resin matrix. As is well known in the art, such parts can be obtained by covering sheets of fibres impregnated with thermosetting resin, followed by the polymerization of the resin.

In addition, the parts 16 and 18 can have various shapes without passing outside the scope of the invention. In the case illustrated in FIG. 1A, the parts 16 and 18 are in the form of plates, having substantially uniform and equal thicknesses. These plates can be planar, inwardly curved, or have any other shape adapted to the envisaged application.

In the embodiment illustrated in FIG. 1A, the parts 16 and 18 are placed edge to edge in an extension of one another. In other words, the parts 16 and 18 are in contact with one another by adjacent edges, which have complimentary shapes. These adjacent edges define the separation line 20 between the two assemblies 10 and 12, when use is made of the means for separating device 14. This separation line 20 can have a random shape (straight, curved, interrupted, etc.) without passing beyond the scope of the invention.

In the embodiment shown in FIG. 1A, parts 16 and 18 are initially fixed to one another by a linking part 22, made from a nonmetallic material, bonded simultaneously to adjacent portions of said parts 16, 18 and forming a portion of the device 14 according to the invention.

More specifically, the linking part 22 is in the form of a strip or band overlapping the separation line 20 between parts 16 and 18, so as to be simultaneously bonded to the faces of said parts located in the extension of one another. Said band can have a uniform thickness, as shown, or can be non-uniform. Preferably the bonding surface of the linking part 22 to the first part 16 is significantly smaller than the bonding surface of the part 22 to the second part 18. However, the dimensions of the two bonding surfaces are adequate to ensure the desired initial linking between the parts 16 and 18, taking account of the adhesive used.

Like that forming the parts 16, 18, the nonmetallic material from which is formed the linking part 22 can be of a random nature without passing beyond the scope of the invention. Advantageously, it is a composite material formed from sheets of long fibres embedded in a polymerized resin matrix.

The adhesive by which the linking part 22 is bonded to the adjacent portions of parts 16, 18 can also be of a random nature without passing outside the scope of the invention. It is chosen so as to ensure an adequate fixing, bearing in mind the forces and stresses having to be transmitted between the parts 16 and 18 prior to their separation. This adhesive can in particular be a polymerized resin of the same type as that used in the composition of parts 16, 18 and 22, when the latter are made from composite materials.

Besides the linking part 22 ensuring the provisional link between assemblies 10 and 12, the device 14 according to the invention comprises means for the pyrotechnic separation of said two assemblies. In this case, the pyrotechnic separation means comprise a pyrotechnic expansion tube 24, a support part 26 and a spacer 28. The two latter parts can be separate or made in one piece, in the manner shown.

The pyrotechnic expansion tube 24 is made in the same way as in the devices used for the cutting of metallic parts. However, it has reduced dimensions adapted to the linking by bonding of parts 16 and 18. Thus, it produces a much lower shock wave than the tubes used in the devices for cutting metallic parts. Thus, there is no need to provide a detailed description of the pyrotechnic expansion tube.

To facilitate understanding, it is merely pointed out that the pyrotechnic expansion tube comprises a tight, deformable, metal envelope 30, a detonating fuse or cord 32 housed within the envelope 30, as well as a flexible material 34 placed between the detonating fuse 32 and the envelope 30. The flexible material 34 serves to center the detonating fuse within the envelope. For example, it can be made from silicone rubber. Prior to firing, the envelope 30 has an oblong cross-section, e.g. in the form of a flattened circle or oval, as illustrated by FIG. 1A.

The pyrotechnic expansion tube 24 is received in a space 36 formed between the support part 26 and the portion of the second part 18 to which is bonded the linking part 22. Said space 36 is also defined on one side by a face 38 of the spacer 28. More specifically, the greatest length section of the envelope 30 is oriented parallel to the direction defined by the parts 16, 18 to be separated.

The support part 26 and spacer 28 belong to the first structural assembly 10. They are fixed to the first part 16 in such a way that the face 38 of spacer 28 is aligned with the separation line 20, i.e. with the contacting edges of parts 16, 18.

Figure 1B:
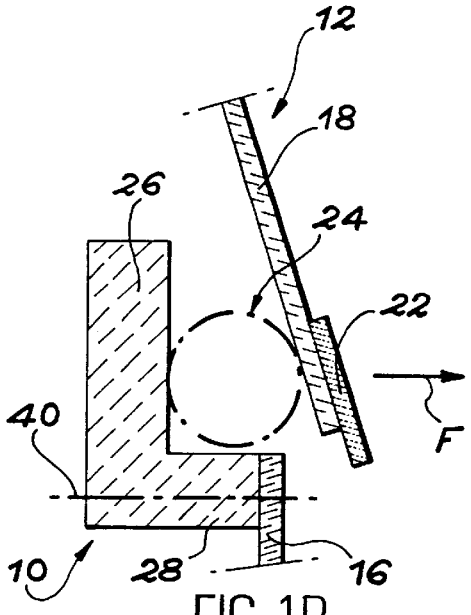

In the embodiment illustrated in FIGS. 1A and 1B, the support part 26 and spacer 28 form a single part separate from the first part 16. Said single part is fixed to the first part 16 by fixing means such as not shown bolts, whose location is diagrammatically illustrated by the mixed line 40. This location is as close as possible to the face 38 of the spacer, i.e. the separation line 20.

The nature and thickness of the materials constituting the support part 26 and the spacer 28 are such that said two parts are substantially non-deformable during the operation of the pyrotechnic expansion tube 24. This result is obtained either by using non-deformable materials of limited thickness, such as metals, or by using relatively flexible, but more thick materials, such as nonmetallic materials, in the manner illustrated in FIGS. 1A and 1B. In the latter case, it should be noted that as a variant, the support part 26 and spacer 28 can be made in one piece with the first part 16. The fixing means illustrated by the mixed line 40 are then no longer necessary.

In all cases the face of the support part 26 turned towards the second part 18 constitutes a substantially non-deformable surface, which is generally parallel to the second part 18 and on which bears the pyrotechnic expansion tube 24 during the firing of the detonating fuse 32. Consequently the expansion of the envelope 30 takes place totally in the direction of the second part 18, as is diagrammatically illustrated in FIG. 1B.

It should be noted that the thickness of the pyrotechnic expansion tube 24 is substantially equal, to within the assembly clearance, to the width of the space 36 between the second part 18 and the support part 26. A not shown element can be connected to the support 26, or formed directly on said part in order to close the space 36 opposite to spacer 28, if this should prove necessary in order to prevent the release of tube 24.

As shown in FIG. 1B, when the detonating fuse 32 is fired, the resulting shock wave brings about the expansion of envelope 30, which tends to assume a substantially circular cross-section. In view of the fact that the pyrotechnic expansion tube 24 bears on a substantially non-deformable part 26, its expansion essentially takes place in the direction of the second part 18. It is consequently entirely applied to said second part 18.

Due to the fact that the first part 16 is integral with the support part 26 by means of the spacer 28 and fixing means symbolized by the mixed line 40, there is consequently a relative displacement between the adjacent portions of parts 16 and 18, in a direction perpendicular to said parts. This relative displacement is illustrated by arrow F in FIG. 1B and has the effect of detaching the linking part 22. As the bonding surface of the linking part 22 to the first part 16 is significantly smaller than that linking together the two parts 18 and 22, the linking part 22 is detached from the first part 16. However, the linking part 22 tends to remain bonded to the second part 18. However, it may be detached without passing outside the scope of the invention.

Therefore a precise, clean and perfectly localized separation takes place between the two assemblies 10 and 12 without any severe shock being produced.

Figure 2A:
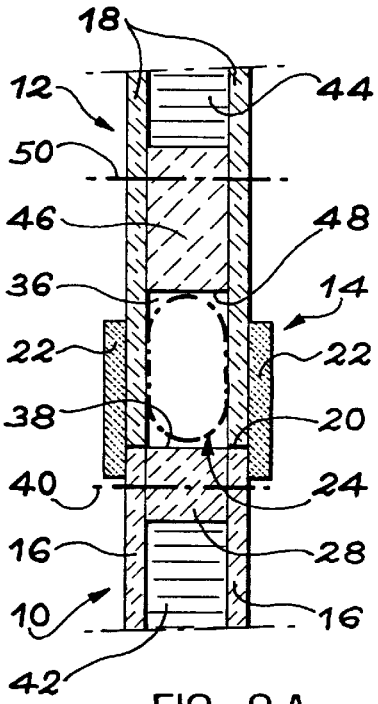
FIGS. 2A and 2B Diagrammatic sectional views showing a variant of the device of FIGS. 1A and 1B, respectively before and after separation, in the case where two pairs of nonmetallic parts have to be separated.
Figure 2B:
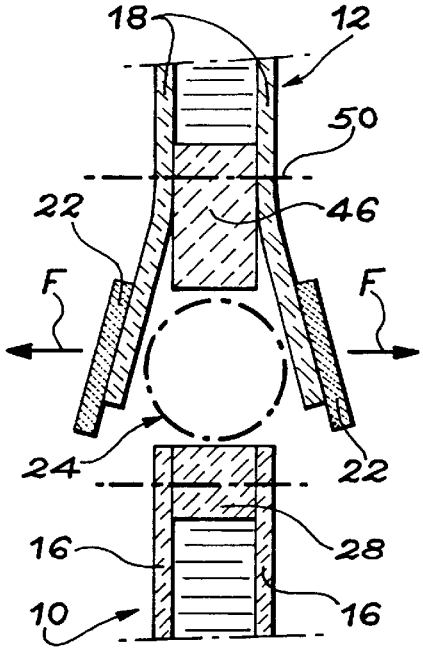

FIGS. 2A and 2B show a variant of the first embodiment of the invention described hereinbefore relative to FIGS. 1A and 1B. This variant relates to the case where the device 14 according to the invention initially links two assemblies 10 and 12, each comprising a pair of parts 16, 18, respectively of nonmetallic materials.

More specifically, the first assembly 10 then comprises two first parts 16, which are substantially parallel to one another. For example, said parts 16 form the skins of a sandwich structure, whose core is formed by a foam or cellular material 42, such as a honeycomb material. In the vicinity of one edge of the first part 16 forming the separation line 20 of device 14, the cellular material 42 is replaced by a first, substantially non-deformable spacer 28. One face 38 of said spacer 28 turned towards the outside of the first assembly 10 is aligned with the corresponding edges of the first parts 16 on the separation line 20.

In the embodiment shown, the spacer 28 is fixed between the parts 16 by not shown fixing means, such as bolts, symbolized by the mixed line 40 and placed close to the separation line 20.

It should be noted that in a variant, the first spacer 28 can be in one piece with the first parts 16.

The second assembly 12 comprises in this case two second parts 18, which are substantially parallel to one another. Said second parts 18 e.g. form the skins of a second sandwich structure, whose core is formed by a cellular material 44, such as a honeycomb material. In the vicinity of the edges of the two parts 18 aligned on the separation line 20 of device 14 according to the invention, the cellular material is eliminated in order to define a space 36 between the terminal portions of parts 18. Beyond said space 36, the cellular material 44 is replaced by a second spacer 46, whose face 48, turned towards the outside of the assembly 12, also defines the space 36. The second spacer 46 is substantially non-deformable.

In the embodiment shown, the second spacer 46 is fixed between the second parts 18 by not shown fixing means, such as bolts, symbolized by a mixed line 50. These fixing means are as far away as possible from the separation line 20 and face 48 of spacer 46.

As a variant, the second spacer 46 can be made in one piece with the second parts 18. It can also be eliminated, like the cellular material 44, the two parts then being directly joined to one another beyond the space 36.

In the constructional variant of FIGS. 2A and 2B, the device 14 according to the invention comprises two linking parts 22, made from nonmetallic materials and bonded to adjacent portions of each of the parts 16 and 18, when said parts are placed end to end or edge to edge along the separation line 20, as illustrated in FIG. 2A. More specifically, the parts 22 are bonded to the faces of the parts 16 and 18 respectively opposite to the spacer 28 and space 36, i.e. on the faces of the parts turned towards the outside of assemblies 10 and 12.

The device 14 also comprises a pyrotechnic expansion tube 24 placed in space 36, i.e. between surfaces 38, 48 of the spacers and between terminal portions of the second parts 18.

As is diagrammatically illustrated by FIG. 2B, the use of the pyrotechnic expansion tube 24 has the effect of moving apart the terminal portions of the two parts 18, by making them pivot about their fixing means materialized by the mixed line 50. The linking parts 22 are thus separated from the first parts 16 (arrows F) and the elements 10 and 12 are separated from one another.

Figure 3A:
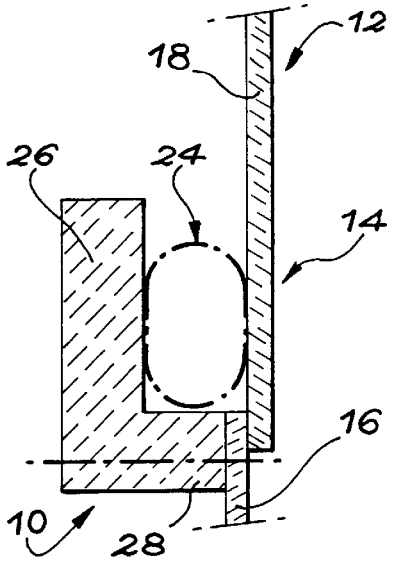
FIGS. 3A and 3B Sectional views diagrammatically showing a second embodiment of the device according to the invention, respectively before and after separation, in the case where only two nonmetallic parts have to be separated.
Figure 3B:
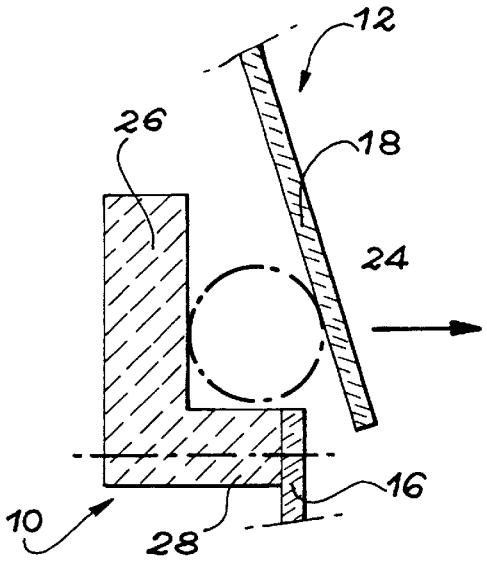

FIGS. 3A and 3B diagrammatically show a second embodiment of device 14 according to the invention. As in FIGS. 1A and 1B, FIGS. 3A and 3B relate to the separation of two single parts 16, 18 belonging to two separate assemblies 10, 12, which are initially linked and which it is wished to separate. Therefore the general arrangement is comparable to that described hereinbefore relative to FIGS. 1A and 1B, so that a new and detailed description will not be given.

The embodiment of FIGS. 3A and 3B differs from the first embodiment by the nature of the linking means by which assemblies 10 and 12 are fixed to one another, prior to the operation of the pyrotechnic expansion tube 24.

In the case of FIGS. 3A and 3B, the linking part 22 is eliminated and the link between the parts 16, 18 is ensured by the direct bonding of an end portion of the second part 18 to an end portion of the first part 16, facing the spacer 28. Consequently the parts 16 and 18 are not placed end to end or edge to edge, but instead overlap on a clearly defined surface in order to ensure the desired mechanical connection prior to separation.

The pyrotechnic expansion tube 24 then acts on a portion of the second part 18 adjoining its end portion fixed by bonding to the first part 16.

As hereinbefore (FIG. 3B), the operation of the pyrotechnic expansion tube 24 separates the assemblies 10 and 12, by in this case detaching the second part 18 from the first part 16. To this end, the tube 24 bears on the support part 26, linked to the first part 16 via spacer 28.

Figure 4A:
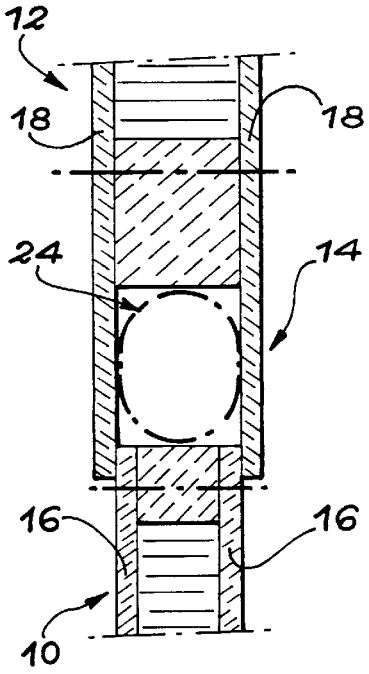
FIGS. 4A and 4B Diagrammatic sectional views showing a variant of the device of FIGS. 3A and 3B, respectively before and after separation, in the case where two pairs of nonmetallic parts have to be separated.
Figure 4B:
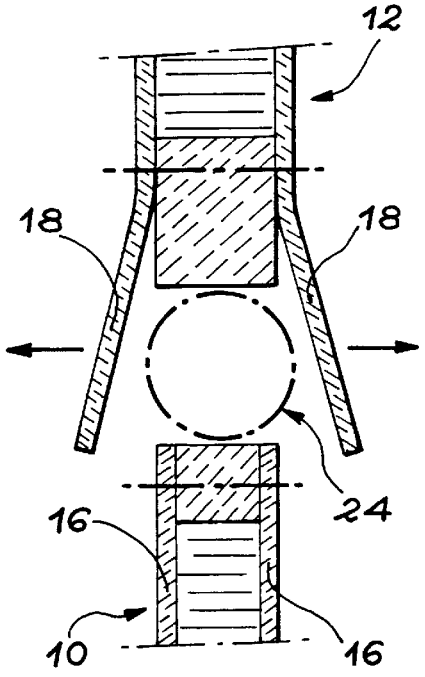

FIGS. 4A and 4B show a variant of the second embodiment of the invention, applied to the case where each of the assemblies 10 and 12 respectively comprises two parts 16 and 18. The arrangement is essentially identical to that described hereinbefore relative to FIGS. 2A and 2B, so that a detailed description will not again be given.

According to the second embodiment of the invention described hereinbefore relative to FIGS. 3A and 3B, the linking parts 22 are eliminated and the end portions of the second parts 18 are directly bonded to the end portions of the first part 16 on outer faces thereof.

The operation of the pyrotechnic expansion tube 24 (FIG. 4B) has the effect of simultaneously detaching the two parts 18 from the two parts 16 and consequently brings about a separation of assemblies 10 and 12.

In general terms, device 14 according to the invention in all cases permits a direct separation of the two assemblies 10 and 12 made from nonmetallic materials and more particularly composite materials, along a clearly defined and well localized separation line with satisfactory cleanness conditions.

It should be noted that the simultaneous separation of two pairs of parts (FIGS. 2A/2B and 4A/4B) is preferable when this is possible, as a result of the resulting perfect symmetry of the device. Thus, the energy required for ensuring separation is then of a minimum nature.

In all cases, the direct separation of nonmetallic materials leads to a significant reduction of the energy required for separation compared with the prior art procedure, in which it was necessary to cut intermediate metallic parts. Consequently the shock produced by the separation is very significantly reduced, which is an important advantage with regards to any equipment and installations which may be embarked in the vicinity of the device.

Finally, when the device comprises two pairs of parts (FIGS. 2A/2B and 4A/4B), the separation lines 20 can either be aligned with the same spacer 28, as shown, or aligned with each of the spacers 28 and 46.

What is claimed is:

1. A provisional linking and pyrotechnic device, comprising:

at least one linking part bonded to adjacent portions of the first and second nonmetallic parts arranged in contact with each other by adjacent edges, the first and second nonmetallic parts respectively belonging to first and second assemblies to be separated; and a pyrotechnic expansion tube disposed in a space formed opposite to the at least one linking part and substantially facing the adjacent portion of the second nonmetallic part.

2. The device according to claim 1, wherein a bonding surface of the at least one linking part bonded to the first nonmetallic part is substantially smaller than a bonding surface of the at least one linking part bonded to the second nonmetallic part.

3. The device according to claim 1, wherein the first assembly further comprises:

a support part and a spacer configured to support the pyrotechnic expansion tube and to provide a spacing sufficient to receive the pyrotechnic expansion tube, wherein the second assembly is a single part, and wherein the space is defined between the support part, the spacer and the adjacent portion of the second nonmetallic part.

4. The device according to claim 3, wherein the first assembly including the support part and the spacer form a single part separate from the first nonmetallic part, and wherein the single part is fixed to the first nonmetallic part.

5. The device according to claim 3, wherein the first assembly including the support part and spacer, and the first nonmetallic part form a single part.

6. The device according to claim 1, wherein the first assembly comprises:

two first nonmetallic parts substantially parallel to each other; and a first spacer linking the two first nonmetallic parts, wherein the second assembly comprises:

two second nonmetallic parts substantially parallel to each other; and a second spacer linking the two second nonmetallic parts, and wherein the space is defined between adjacent portions of the two second nonmetallic parts and between the first and second spacers.

7. The device according to claim 6, wherein the second spacer is fixed between the two second nonmetallic parts at a location remote from the space.

8. The device according to claim 6, wherein the first assembly further comprises a first core disposed adjacent to the first spacer and between the two first nonmetallic parts, and the second assembly further comprises a second core disposed adjacent to the second spacer and between the two second nonmetallic parts.

9. The device according to claim 6, wherein a face of the first spacer facing the space is substantially aligned with an edge of each of the two first nonmetallic parts.

10. The device according to claim 6, wherein the first spacer is fixed between the two first nonmetallic parts at a location in the vicinity of said space.

11. A provisional linking and pyrotechnic device, comprising:

first and second assemblies to be separated and respectively including first and second nonmetallic parts arranged in contact with each other such that an end portion of the second nonmetallic part is bonded and overlaps an end portion of the first nonmetallic part; and a pyrotechnic expansion tube disposed in a space formed opposite to a portion of the second nonmetallic part adjoining its end portion which overlaps the end portion of the first nonmetallic part.

12. The device according to claim 11, wherein the first assembly further comprises:

a support part and a spacer configured to support the pyrotechnic expansion tube and to provide a spacing sufficient to receive the pyrotechnic expansion tube, wherein the second assembly is a single part, and wherein the space is defined between the support part, the spacer and the adjacent portion of the second nonmetallic part.

13. The device according to claim 12, wherein the first assembly including the support part and the spacer form a single part separate from the first nonmetallic part, and wherein the single part is fixed to the first nonmetallic part.

14. The device according to claim 12, wherein the first assembly including the support part and spacer, and the first nonmetallic part form a single part.

15. The device according to claim 11, wherein the first assembly comprises:

two first nonmetallic parts substantially parallel to each other; and a first spacer linking the two first nonmetallic parts, wherein the second assembly comprises:

two second nonmetallic parts substantially parallel to each other; and a second spacer linking the two second nonmetallic parts, and wherein the space is defined between adjacent portions of the two second nonmetallic parts and between the first and second spacers.

16. The device according to claim 15, wherein the second spacer is fixed between the two second nonmetallic parts at a location remote from the space.

17. The device according to claim 15, wherein the first assembly further comprises a first core disposed adjacent to the first spacer and between the two first nonmetallic parts, and the second assembly further comprises a second core disposed adjacent to the second spacer and between the two second nonmetallic parts.

18. The device according to claim 15, wherein a face of the first spacer facing the space is substantially aligned with an edge of each of the two first nonmetallic parts.

19. The device according to claim 15, wherein the first spacer is fixed between the two first nonmetallic parts at a location in the vicinity of said space.

* * * * *